United States Patent [19]

Jones

[11] Patent Number: 5,044,593

[45] Date of Patent: Sep. 3, 1991

[54] COPY HOLDER

[76] Inventor: Hwfa J. Jones, 47 Penkett Road, Wallasey, Wirral, Merseyside, England, L45 7QC

[21] Appl. No.: 479,674

[22] Filed: Feb. 15, 1990

[30] Foreign Application Priority Data

Feb. 18, 1989 [GB] United Kingdom ..... 8903718

[51] Int. Cl.[5] ..... B41J 11/02

[52] U.S. Cl. ..... 248/442.2; 248/205.3; 248/918

[58] Field of Search ..... 248/441.1, 442.2, 918, 248/205.3, 451, 452, 447.1, 289, 282; 24/67 R, 488; 400/718, 718.1, 718.2; 403/163, 161, 92, 96

[56] References Cited

U.S. PATENT DOCUMENTS

| | | | |
|---|---|---|---|
| 1,615,959 | 2/1927 | Slavik | 248/442.2 |
| 3,637,186 | 1/1972 | Greenfield | 248/289.1 X |
| 3,918,668 | 11/1925 | Thorpe | 248/205.3 |
| 4,475,705 | 10/1984 | Henneberg et al. | 248/442.2 X |
| 4,632,471 | 12/1986 | Visnapull | 312/7.2 X |
| 4,693,443 | 9/1987 | Drain | 24/488 X |
| 4,712,870 | 12/1987 | Robinson et al. | 248/918 X |
| 4,767,093 | 8/1988 | Jones | 248/205.3 X |
| 4,902,078 | 2/1990 | Judd | 248/442.2 X |
| 4,921,271 | 5/1990 | Berry et al. | 403/96 X |
| 4,934,648 | 6/1990 | Yueh | 248/442.2 |

FOREIGN PATENT DOCUMENTS

| | | | |
|---|---|---|---|
| 0849668 | 9/1960 | United Kingdom | 24/488 |

*Primary Examiner*—Ramon O. Ramirez

*Attorney, Agent, or Firm*—Shlesinger Arkwright & Garvey

[57] ABSTRACT

A copy holder device or supporting at least one sheet comprises a body having an extension arm for receiving a sheet and an attachment arm having attachment means for attachment to a surface of an office machine and a coupling mechanism between the extension and attachment arms which permits rotation of one arm with respect to the other.

6 Claims, 2 Drawing Sheets

COPY HOLDER

FIELD

The present invention relates to a copy holder for supporting copy or notes to be typed on, for example, a personal computer, word processor, typewriter, etc.

BACKGROUND

Copy holders are used to support copy or notes in a position where the contents can easily be read by a typist whilst typing them on a keyboard. It should not be underestimated how useful copy holders are. Copy which is badly positioned can give the typist a great deal of physical discomfort and can result in a reduction in the typist's speed.

A variety of copy holders are known, one of which attaches to the typist's equipment and it is to this type of copy holder that the present invention relates. These copy holders comprise of two substantially blade-like interconnected arms, one of which serves as an attachment by a fastener, such as double sided adhesive tape, to the typist's equipment and the other as a extension for attaching the copy in a convenient position for the typist adjacent to the monitor or visual display unit.

SUMMARY OF THE INVENTION

The present invention allows the two arms to be separated by means of a rotatable joint thus saving considerably on space when the copy holder is packaged and provides for a bracing system of high efficiency which much reduces the tendency of the copyholding arm to sag under load and provides stability to the copy. The arrangement allows substantial savings in materials.

Preferably each arm is terminated by a flanged cylinder such that one cylinder fits within the other and is locked when the flanges are opposite each other. The flanges are of sufficient length to allow the copy to be rotated to the most convenient position for the typist. The joint can only be separated by rotating to a position that would set the arms substantially at right angles, a position not used by the typist.

The bottom of the cylinder on the attachment arm may be moulded to provide a substantially vertical face which braces or cantilevers the copyholding extension adjacent to the monitor or visual display unit, helping to prevent sagging by providing points of contact at substantially right angles to the copyholding extension in the substantially vertical plane and provides stability in the substantially horizontal plane. The importance of having a substantial support at this point should not be underestimated, particularly as the copy holder can be rotated by the typist to the most convenient angle which imposes considerable leverage at this point including horizontal, vertical twist motions.

The extension arm may have a cross section which is substantially T-shaped to aid rigidity.

In another preferred embodiment the substantially bladelike extension arm braces vertically against the attachment arm at the bottom of the cylindrical section of the attachment arm to which it is attached by means of the flanged connection as described above. This provides extra support under load.

BRIEF DESCRIPTION OF THE DRAWINGS

Embodiments of the present invention will now be described by way of example, with reference to the accompanying drawings, in which.

DETAILED DESCRIPTION WITH REFERENCE TO THE DRAWINGS

Figure 1:
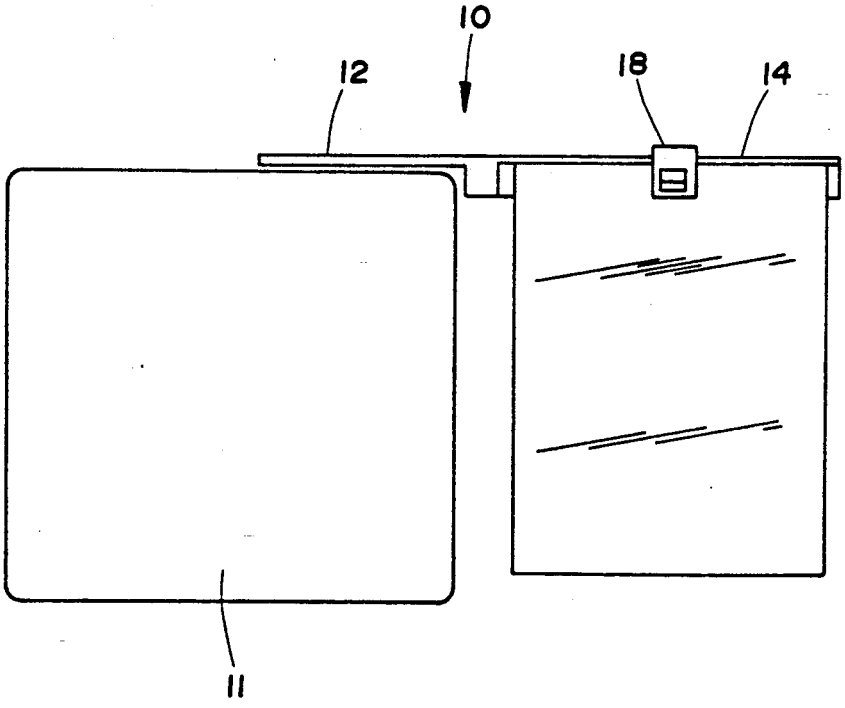
FIG. 1 is an elevational view of the copy holder with a page clipped on and the copy holder attached to a monitor.
Figure 4:
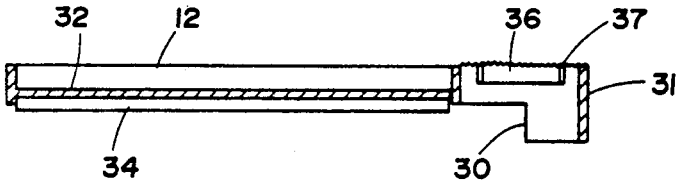
FIG. 4 is an elevational view of the attachment arm.
Figure 5:
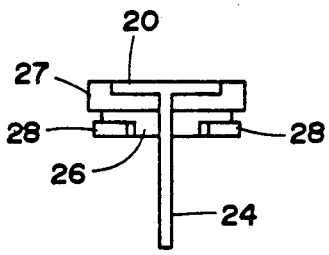
FIG. 5 is an end view of the extension arm without the paper clamp mounted thereon.

Referring to FIG. 1 there is shown a copy holder 10 with an attachment arm 12 which is attached to a monitor or visual display unit 11 by a means such as doubled sided adhesive tape 34 (see FIG. 4). Referring to FIGS. 2, 3 and 4 and 5 this arm is releasably attached to the extension arm 14 by means of opposed flanges 28 on the outer cylindrical surface of cylinder 26 which is affixed to extension arm 14 interlocking corresponding opposed flanges 36 on an interior cylindrical surface of cylinder 31 affixed to the attachment arm 12. The copy holder 10 braces or cantilevers against the monitor at 30 which is in effect an abutment wall formed axially of cylindrical section 31 providing support against sagging in a vertical plane and stability in the horizontal plane.

Figure 6:
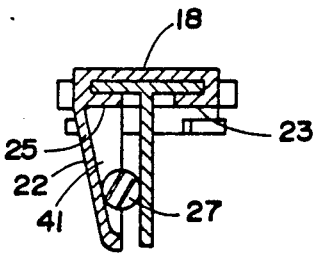
FIG. 6 is a sectional view taken along the line 6—6 in FIG. 2.

A 'T' bar section 16 of the extension arm 14 has slidably attached a paper clamp 18. As shown in FIG. 6 in section, the clamp 18 has two extensions 23 and 25 which extend beneath a cross piece 20 transverse to piece 24. Thus, both sides of cross piece 20 are slidably embraced by clamp 18. A depending portion 22 having a rectangular aperture 39 extends along one face of piece 24 and has a pair of triangular end plates 41 which create a cavity within the clamp with one wall converging downwardly towards piece 24. A short section of cylindrical rod 27 slides within the cavity and when forced downwardly by a user's finger causes depending portion 22 to move outwardly and clamp any sheet(s) which may be between the rod section 27 and piece 24.

Figure 7:
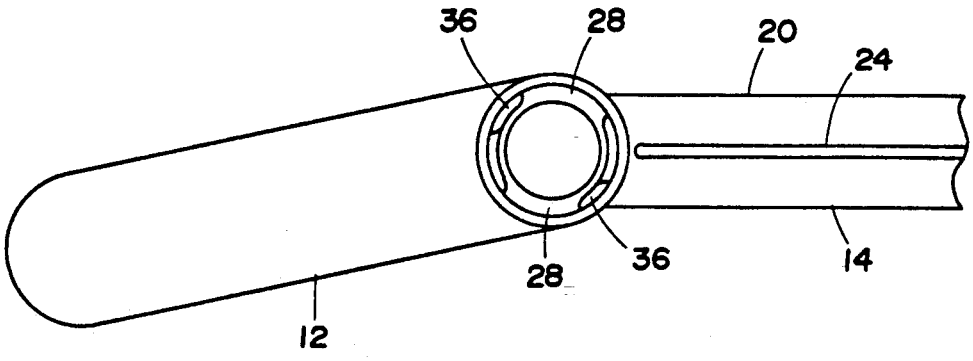
FIG. 7 is a bottom view of the copy holder with a portion of the extension arm broken away.

The interlocking relationship of flanges 28 and 36 is shown in top view in FIG. 7. Initially during insertion of the cylindrical portion 26 of extension arm 14 into the cylinder 31 of attachment arm 12 flanges 28 and 36 are at 90 degrees to each other so that flanges 28 slide past flanges 36 until edge 37 abuts shoulder 43. Arm 12 is then aligned with extension arm 14 bringing flanges 36 into axial alignment with flanges 28. Rotation of extension arm 14 up to angles close to 90 degrees can be tolerated without unlocking of the cylinders.

Figure 2:
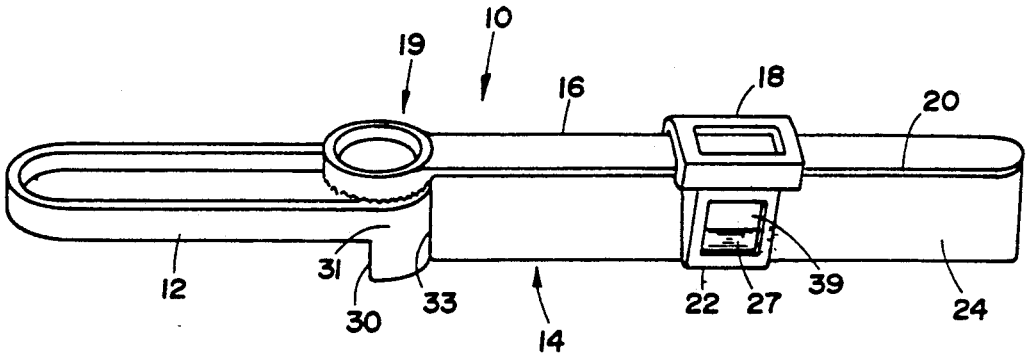
FIG. 2 is a perspective view of the copy holder.
Figure 3:
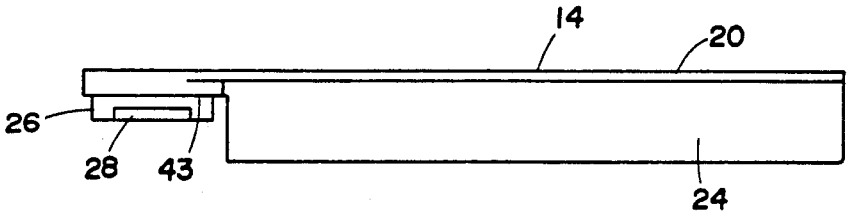
FIG. 3 is an elevational view of the extension arm.

Any sagging on the extension arm 14 at the cylindrical section 19 due to loading would be supported due to the extension arm 14 being braced against the substantially cylindrical section 31 along the end edge 33 of piece 24. As shown in FIGS. 2 and 4 a top edge 37 of cylindrical section 19 of attachment arm 12 is serrated to resist unintentional rotation of extension arm 14 relative to attachment arm 12.

I claim:

1. A copy holder for supporting at least one paper sheet adjacent an office machine comprising:

an attachment arm for attachment to the office machine having a cylindrical section a bottom of which has a substantially vertical face which, when in place, abuts a corresponding vertical surface of said office machine;

an extension arm for supporting the sheet or sheets, said extension harm having a cylindrical section and a vertical face below said cylindrical section;

wherein said extension arm cylindrical section and said attachment arm cylindrical section are removably engageable and when engaged couple said extension arm to said attachment arm so that said extension arm can be rotated relative to said attachment arm and the abutment of the vertical surface on said attachment arm cylindrical section with the vertical surface of said office machine and the abutment of the vertical face of said extension arm with the cylindrical surface of said attachment arm cylindrical section inhibits sagging in a vertical plane.

2. A copy holder according to claim 1 wherein said extension arm has a 'T'-shaped cross section and wherein said extension and attachment arm cylindrical sections have cylindrical flange sections which pass by one another upon insertion of one of said sections into the other and interlock in sliding rotating movement.

3. A copy holder according to claim 1 wherein said attachment arm is attached by a releasable fastener to said office machine.

4. A copy holder according to claim 3 wherein said releasable fastener is double sided adhesive tape.

5. A copy holder according to claim 1 wherein at least one of abutting annular surfaces of said attachment arm and extension arm cylindrical sections is serrated to add friction between the said surfaces against unintentional turning of said extension arm relative to said attachment arm.

6. A copy holder according to claim 1 including a clamp slidable over said extension arm, said clamp having a depending portion extending down adjacent a vertical surface of said extension arm and forming a tapered cavity between the vertical surface and said clamp interior, a cylindrical rod section slidable within the cavity so as to jam against the vertical surface when moved downwardly toward a bottom of said cavity and thereby clamp a sheet or sheets of paper inserted between said rod section and said vertical surface.

* * * * *